US010729934B2

(12) United States Patent
Smith

(10) Patent No.: US 10,729,934 B2
(45) Date of Patent: Aug. 4, 2020

(54) LATERAL ELLIPTICAL TRAINER

(71) Applicant: NAUTILUS, INC., Vancouver, WA (US)

(72) Inventor: Joshua S. Smith, Portland, OR (US)

(73) Assignee: Nautilus, Inc., Vancouver, WA (US)

( * ) Notice: Subject to any disclaimer, the term of this patent is extended or adjusted under 35 U.S.C. 154(b) by 45 days.

(21) Appl. No.: 16/221,029

(22) Filed: Dec. 14, 2018

(65) Prior Publication Data

US 2019/0192900 A1 Jun. 27, 2019

Related U.S. Application Data

(60) Provisional application No. 62/610,046, filed on Dec. 22, 2017.

(51) Int. Cl.
*A63B 22/06* (2006.01)
*A63B 22/00* (2006.01)

(52) U.S. Cl.
CPC ..... *A63B 22/0664* (2013.01); *A63B 22/001* (2013.01); *A63B 22/0015* (2013.01); *A63B 22/0025* (2015.10); *A63B 2022/0028* (2013.01); *A63B 2022/0676* (2013.01); *A63B 2022/0682* (2013.01); *A63B 2225/09* (2013.01)

(58) Field of Classification Search
CPC ..... A63B 22/0664; A63B 22/001; A63B 22/0025; A63B 22/0015; A63B 2022/0682; A63B 2022/0028; A63B 2225/09; A63B 2022/0676; A63B 22/06–0605; A63B 2022/0611–0658; A63B 2022/067–0688; A63B 23/04; A63B 23/0423–0429
See application file for complete search history.

(56) References Cited

U.S. PATENT DOCUMENTS

| | | | | |
|---|---|---|---|---|
| 3,316,898 | A | 5/1967 | Brown | |
| 5,242,343 | A | 9/1993 | Miller | |
| 5,284,460 | A * | 2/1994 | Miller | A63B 21/151 482/145 |
| 5,352,169 | A | 10/1994 | Eschenbach | |
| 5,383,829 | A | 1/1995 | Miller | |
| 5,423,729 | A | 6/1995 | Eschenbach | |
| 5,518,473 | A | 5/1996 | Miller | |
| 5,529,554 | A | 6/1996 | Eschenbach | |
| 5,562,574 | A | 10/1996 | Miller | |
| 5,577,985 | A | 11/1996 | Miller | |
| 5,611,756 | A | 3/1997 | Miller | |
| 5,685,804 | A | 11/1997 | Whan-Tong et al. | |
| 5,692,994 | A | 12/1997 | Eschenbach | |

(Continued)

FOREIGN PATENT DOCUMENTS

| | | |
|---|---|---|
| WO | 2014186600 A1 | 11/2014 |
| WO | 2017165393 A1 | 9/2017 |

OTHER PUBLICATIONS

PCT International Search Report and Written Opinion, PCT Application No. PCT/US2018/065751 dated Mar. 22, 2019, 14 pages.

*Primary Examiner* — Andrew S Lo
(74) *Attorney, Agent, or Firm* — Dorsey & Whitney LLP

(57) ABSTRACT

A lateral elliptical trainer includes foot support platforms and an adjustment system configured to adjust the amount of lateral movement of the foot support platforms. The adjustment system includes a cable operative to adjust the amount of lateral movement of the foot support platforms. The cable is coupled to an actuator that is controllable by a user to enable the user to set the amount of lateral movement of the foot support platforms.

20 Claims, 8 Drawing Sheets

(56) References Cited

U.S. PATENT DOCUMENTS 5,707,321 A 1/1998 Maresh
5,725,457 A 3/1998 Maresh
5,735,774 A 4/1998 Maresh
5,755,642 A 5/1998 Miller
5,788,609 A 8/1998 Miller
5,788,610 A 8/1998 Eschenbach
5,792,026 A 8/1998 Maresh
5,803,871 A 9/1998 Stearns et al.
5,836,854 A 11/1998 Kuo
5,836,855 A 11/1998 Eschenbach
5,846,166 A 12/1998 Kuo
5,848,954 A 12/1998 Stearns et al.
5,857,941 A 1/1999 Maresh et al.
5,876,307 A 3/1999 Stearns et al.
5,876,308 A 3/1999 Jarvie
5,879,271 A 3/1999 Stearns et al.
5,882,281 A 3/1999 Stearns et al.
5,893,820 A 4/1999 Maresh et al.
5,895,339 A 4/1999 Maresh
5,897,463 A 4/1999 Maresh
5,911,649 A 6/1999 Miller
5,916,064 A 6/1999 Eschenbach
5,919,118 A 7/1999 Stearns et al.
5,921,894 A 7/1999 Eschenbach
5,924,963 A 7/1999 Maresh et al.
5,935,046 A 8/1999 Maresh
5,938,568 A 8/1999 Maresh et al.
5,938,570 A 8/1999 Maresh
5,947,872 A 9/1999 Ryan et al.
5,957,814 A 9/1999 Eschenbach
5,967,944 A 10/1999 Vittone et al.
5,993,359 A 11/1999 Eschenbach
5,997,445 A 12/1999 Maresh et al.
6,024,676 A 2/2000 Eschenbach
6,027,430 A 2/2000 Stearns et al.
6,027,431 A 2/2000 Stearns et al.
6,030,320 A 2/2000 Stearns et al.
6,042,512 A 3/2000 Eschenbach
6,045,487 A 4/2000 Miller
6,045,488 A 4/2000 Eschenbach
6,053,847 A 4/2000 Stearns et al.
6,063,009 A 5/2000 Stearns et al.
6,077,196 A 6/2000 Eschenbach
6,077,197 A 6/2000 Stearns et al.
6,077,198 A 6/2000 Eschenbach
6,080,086 A 6/2000 Maresh et al.
6,083,143 A 7/2000 Maresh
6,090,013 A 7/2000 Eschenbach
6,090,014 A 7/2000 Eschenbach
6,099,439 A 8/2000 Ryan et al.
6,113,518 A 9/2000 Maresh et al.
6,123,650 A 9/2000 Birrell
6,126,574 A 10/2000 Stearns et al.
6,135,923 A 10/2000 Stearns et al.
6,142,915 A 11/2000 Eschenbach
6,146,313 A 11/2000 Whan-Tong et al.
6,165,107 A 12/2000 Birrell
6,168,552 B1 1/2001 Eschenbach
6,171,215 B1 1/2001 Stearns et al.
6,171,217 B1 1/2001 Cutler
6,176,814 B1 1/2001 Ryan et al.
6,183,397 B1 2/2001 Stearns et al.
6,183,398 B1 2/2001 Rufino et al.
6,190,289 B1 2/2001 Pyles et al.
6,196,948 B1 3/2001 Stearns et al.
6,206,804 B1 3/2001 Maresh
6,210,305 B1 4/2001 Eschenbach
6,217,485 B1 4/2001 Maresh
6,248,044 B1 6/2001 Stearns et al.
6,248,045 B1 6/2001 Stearns et al.
6,248,046 B1 6/2001 Maresh et al.
6,254,514 B1 7/2001 Maresh et al.
6,277,054 B1 8/2001 Kuo et al.
6,283,895 B1 9/2001 Stearns et al.
6,302,825 B1 10/2001 Stearns et al.
6,312,362 B1 11/2001 Maresh et al.
6,334,836 B1 1/2002 Segasby
6,338,698 B1 1/2002 Stearns et al.
6,340,340 B1 1/2002 Stearns et al.
6,361,476 B1 3/2002 Eschenbach
6,387,017 B1 5/2002 Maresh
6,390,953 B1 5/2002 Maresh et al.
6,398,695 B2 6/2002 Miller
6,409,632 B1 6/2002 Eschenbach
6,409,635 B1 6/2002 Maresh et al.
6,416,442 B1 7/2002 Stearns et al.
6,422,976 B1 7/2002 Eschenbach
6,422,977 B1 7/2002 Eschenbach
6,436,007 B1 8/2002 Eschenbach
6,440,042 B2 8/2002 Eschenbach
6,450,925 B1 9/2002 Kuo
6,454,682 B1 9/2002 Kuo
6,461,277 B2 10/2002 Maresh et al.
6,482,130 B1 11/2002 Pasero et al.
6,482,132 B2 11/2002 Eschenbach
6,500,096 B1 12/2002 Farney
6,527,677 B2 3/2003 Maresh
6,527,680 B1 3/2003 Maresh
6,540,646 B2 4/2003 Stearns et al.
6,544,146 B1 4/2003 Stearns et al.
6,547,701 B1 4/2003 Eschenbach et al.
6,551,217 B2 4/2003 Kaganovsky et al.
6,551,218 B2 4/2003 Goh
6,554,750 B2 4/2003 Stearns et al.
6,565,486 B2 5/2003 Stearns et al.
6,569,061 B2 5/2003 Stearns et al.
6,575,877 B2 6/2003 Rufino et al.
6,579,210 B1 6/2003 Stearns et al.
6,612,969 B2 9/2003 Eschenbach
6,629,909 B1 10/2003 Stearns et al.
6,849,032 B2 2/2005 Chu
7,462,134 B2 * 12/2008 Lull ..... A63B 22/0015 482/52
7,513,854 B1 4/2009 Stearns et al.
7,591,762 B2 * 9/2009 Chang ..... A63B 22/001 482/52
7,608,019 B1 10/2009 Stearns et al.
7,645,215 B2 * 1/2010 Gordon ..... A63B 21/155 482/51
7,833,134 B2 * 11/2010 Gordon ..... A63B 22/0017 482/51
7,981,007 B1 7/2011 Chu
8,062,186 B2 11/2011 Nelson et al.
8,167,778 B2 5/2012 Lai
8,206,271 B2 6/2012 Chu
8,272,995 B2 9/2012 Stearns et al.
8,444,580 B2 5/2013 Ochi et al.
8,852,059 B1 10/2014 Stearns et al.
9,364,707 B2 6/2016 Grossman et al.
2001/0011053 A1 8/2001 Miller
2001/0051562 A1 12/2001 Stearns et al.
2002/0019298 A1 2/2002 Eschenbach et al.
2002/0055420 A1 5/2002 Stearns et al.
2002/0128122 A1 9/2002 Miller et al.
2002/0142890 A1 10/2002 Ohrt et al.
2002/0155927 A1 10/2002 Corbalis et al.
2003/0022763 A1 1/2003 Ryan et al.
2005/0272562 A1 12/2005 Alessandri et al.
2006/0046902 A1 3/2006 Chang
2007/0027001 A1 2/2007 Alessandri et al.
2007/0167289 A1 7/2007 Alessandri et al.
2007/0225130 A1 9/2007 Maffei et al.
2008/0132385 A1 6/2008 Alessandri et al.
2009/0176624 A1 7/2009 Chang
2009/0203502 A1 * 8/2009 Neuberg ..... A63B 22/0048 482/70
2011/0312471 A1 * 12/2011 Anderson ..... A63B 21/154 482/52
2016/0089562 A1 * 3/2016 Grossmann ..... A63B 21/4047 482/52

* cited by examiner

FIG. 11
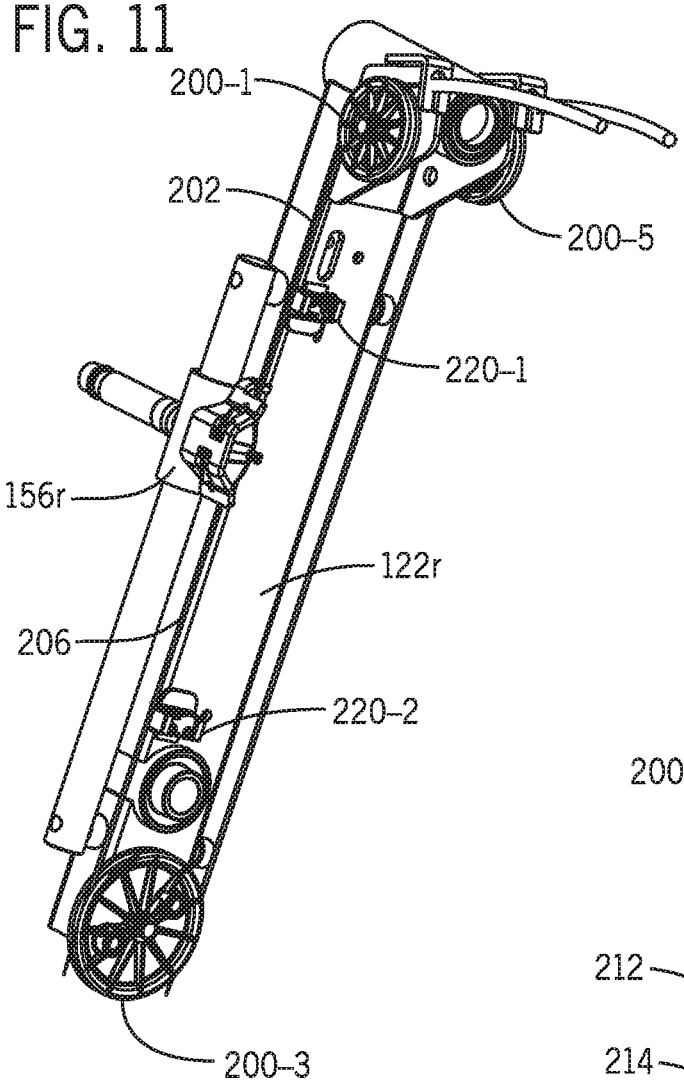
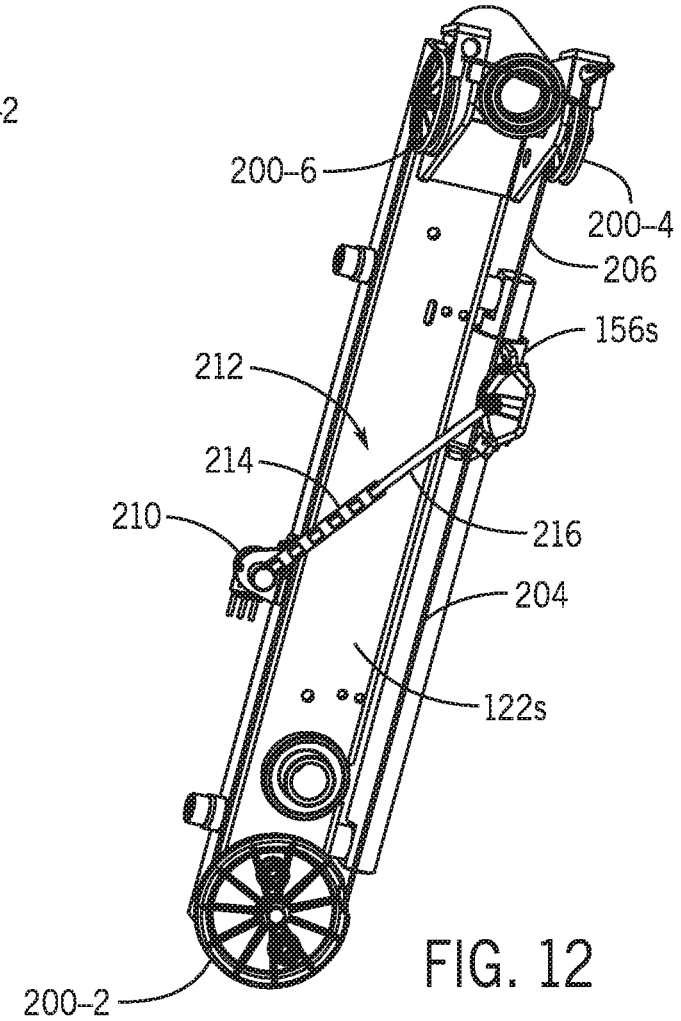
FIG. 12

LATERAL ELLIPTICAL TRAINER

CROSS-REFERENCE TO RELATED APPLICATIONS

This application claims the benefit of priority of under 35 U.S.C. 119(e) of U.S. Provisional Patent Application No. 62/610,046 filed Dec. 22, 2017 and entitled "LATERAL ELLIPTICAL TRAINER," which are hereby incorporated herein in their entireties.

FIELD

The present disclosure relates generally to an exercise machine having lateral motion features, which is generally referred to as a lateral elliptical trainer.

BACKGROUND

One type of stationary cardiovascular exercise equipment which has become popular based predominantly upon its low-impact and natural motion is the elliptical exercise machine. A wide variety of elliptical exercise machines have been developed. Briefly, elliptical exercise machines typically include foot support platforms supported upon foot links with the foot links pivotally connected at one end through a linkage system to a drive shaft for travel along a defined closed-loop path (e.g., circular, elliptical, oval, etc.) and connected at the other end for reciprocating motion along a defined path as the first end travels along the closed-loop path. This combination of paths of travel at opposite ends of the foot links impart an "elliptical" type motion to the foot support platforms attached to the foot links.

Elliptical-type exercise machines generally provide for longitudinal movement of the foot support platforms during operation of the exercise machine. Some elliptical-type exercise machines include features that provide for lateral motion of foot support platforms. For example, U.S. Pat. No. 9,364,707 discloses a lateral glide elliptical exercise machine with yaw control. The lateral motion feature typically is provided in two modalities: fixed path and adjustable path. The adjustable path devices allow the linkage assembly for each foot link to be selectively adjusted to define a path that the user's foot then follows during use. However, the adjustment system in these devices typically is costly, heavy, and/or complex.

Hence, a substantial need exists for an elliptical exercise machine having lateral motion features with a less expensive, lighter, and/or less complex adjustment system.

SUMMARY

In various embodiments, a lateral elliptical trainer is disclosed. The lateral elliptical trainer may include a frame; a left foot support platform coupled to the frame via a first linkage system, the first linkage system configured to enable longitudinal and lateral movement of the left foot support platform; a right foot support platform coupled to the frame via a second linkage system, the second linkage system configured to enable longitudinal and lateral movement of the right foot support platform; and a lateral adjustment system coupled to the left linkage system and the right linkage system, and operative to adjust the amount of lateral movement of the left foot support platform and the right foot support platform. The lateral adjustment system may include a first carriage slidably coupled to the first linkage system, a second carriage slidably coupled to the second linkage system, a cable coupled to the first carriage and the second carriage, and a cable actuator coupled to the cable and operative to move the first carriage and the second carriage relative to the first linkage system and the second linkage system, respectively, via the cable to adjust the amount of lateral movement of the left foot support platform and the right foot support platform, respectively.

In various embodiments, a lateral adjustment system for a lateral elliptical trainer is disclosed. The lateral adjustment system may include first and second carriages configured to be slidably coupled to first and second linkage systems, respectively, of the lateral elliptical trainer, a cable coupled to the first and second carriages, and a cable actuator coupled to the cable and operative to move the first and second carriages relative to the first and second linkage systems, respectively, via the cable to adjust the amount of lateral movement of left and right foot support platforms, respectively, of the lateral elliptical trainer.

In various embodiments, a method of controlling the lateral displacement of a foot support platform on a lateral elliptical trainer is disclosed. The method may include rotating a drum; moving first and second carriages, coupled to the drum via one or more cables, along a length of first and second rocker arms, respectively, in response to rotating the drum; and moving first and second foot platforms, coupled to the first and second carriages, respectively, via first and second linkage systems, respectively, in a lateral direction in response to moving the first and second carriages, respectively.

This summary of the disclosure is given to aid understanding. Each of the various aspects and features of the disclosure may advantageously be used separately in some instances, or in combination with other aspects and features of the disclosure in other instances. Accordingly, while the disclosure is presented in terms of examples, individual aspects of any example can be claimed separately or in combination with aspects and features of that example or any other example.

This summary is neither intended nor should it be construed as being representative of the full extent and scope of the present disclosure. The present disclosure is set forth in various levels of detail in this application and no limitation as to the scope of the claimed subject matter is intended by either the inclusion or non-inclusion of elements, components, or the like in this summary.

BRIEF DESCRIPTION OF THE DRAWINGS

The accompanying drawings, which are incorporated in and constitute a part of the specification, illustrate examples of the disclosure and, together with the general description given above and the detailed description given below, serve to explain the principles of these examples.

FIG. 11 is an isometric view of a rocker arm and associated components of the adjustment system of FIG. 4 in accordance with various embodiments of the present disclosure.

FIG. 12 is an isometric view of a rocker arm and associated components of the adjustment system of FIG. 4 in accordance with various embodiments of the present disclosure.

The drawings are not necessarily to scale. In certain instances, details unnecessary for understanding the disclosure or rendering other details difficult to perceive may have been omitted. In the appended drawings, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference label. The claimed subject matter is not necessarily limited to the particular examples or arrangements illustrated herein.

DETAILED DESCRIPTION

Embodiments of the present disclosure are directed to an exercise machine having lateral training features. The exercise machine may include foot support platforms, on which a user stands when operating the exercise machine. In operation, the user may move the foot support platforms through a closed-loop path of travel that is defined by linkages, drawbars, and/or other components coupled to the foot support platforms. The travel path of the foot support platforms may include a lateral component, which may be adjusted by the user before or during exercise. To facilitate lateral motion of the foot support platforms, the exercise machine may include one or more housing-supported cables coupled to slidable carriages, which may be slidably coupled to rocker arms of the exercise machine. The one or more cables offer the flexibility to handle the independent motion of each side of the exercise machine in a less expensive, lighter, and/or less complex manner than conventional adjustment systems. In various embodiments, the one or more cables can be attached directly to the carriages, enabling the use of a single cable actuator to control the position of the carriages. Additionally, backlash in the adjustment system can be reduced with bias springs. In various embodiments, the carriages are mechanically coupled together via the one or more cables, thereby reducing the complexity of position sensing because independent position tracking of each side of the exercise machine is not required. The exercise machine may include inertial and/or resistive components that oppose the movement of the foot support platforms along their closed-loop path of travel. By working against the action of these inertial and/or resistive components, the user experiences an athletic exertion as the user moves the foot support platforms along the closed-loop path of travel.

Figure 1:
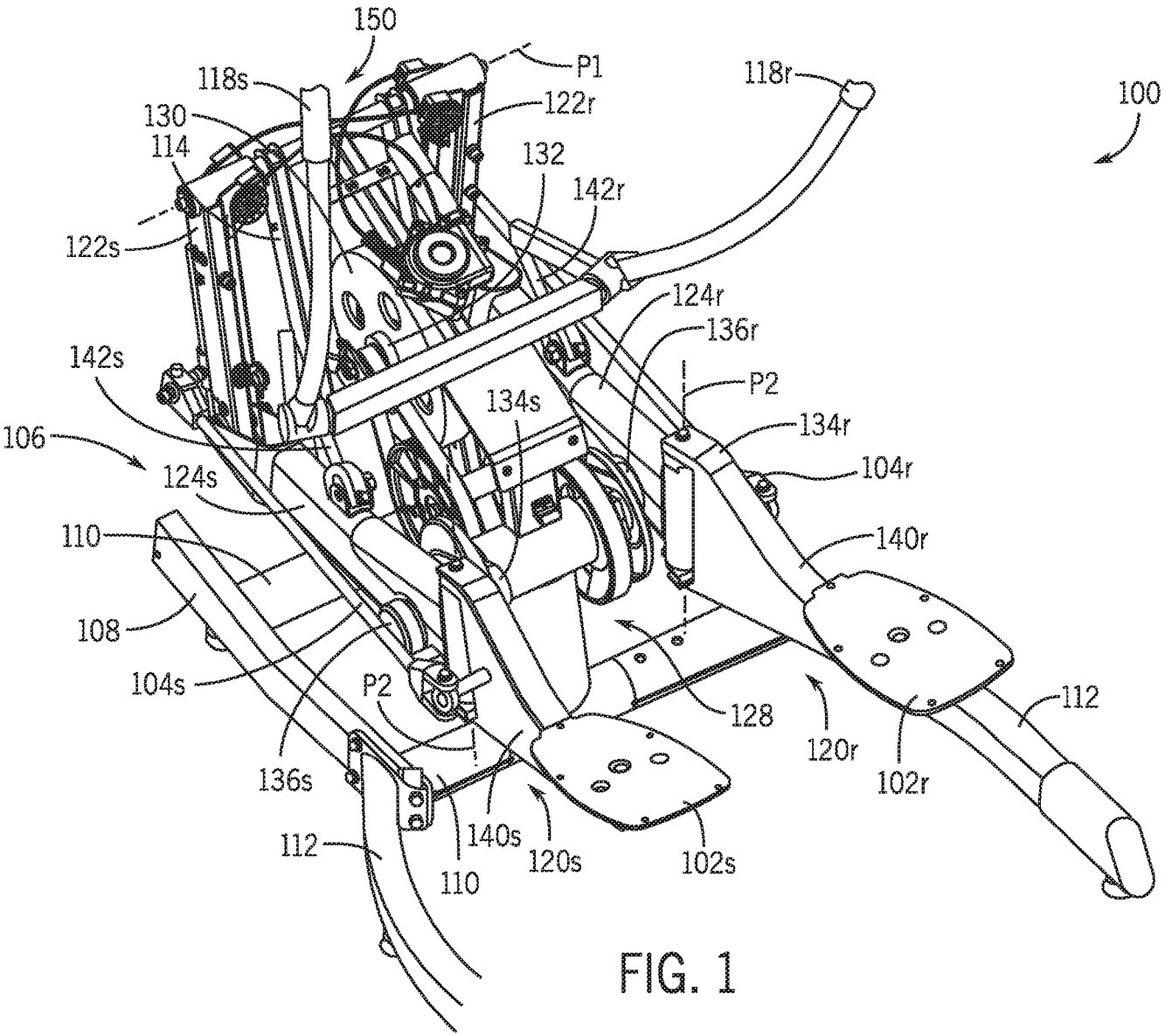
FIG. 1 is an isometric view of a lateral elliptical trainer in accordance with various embodiments of the present disclosure.
Figure 2:
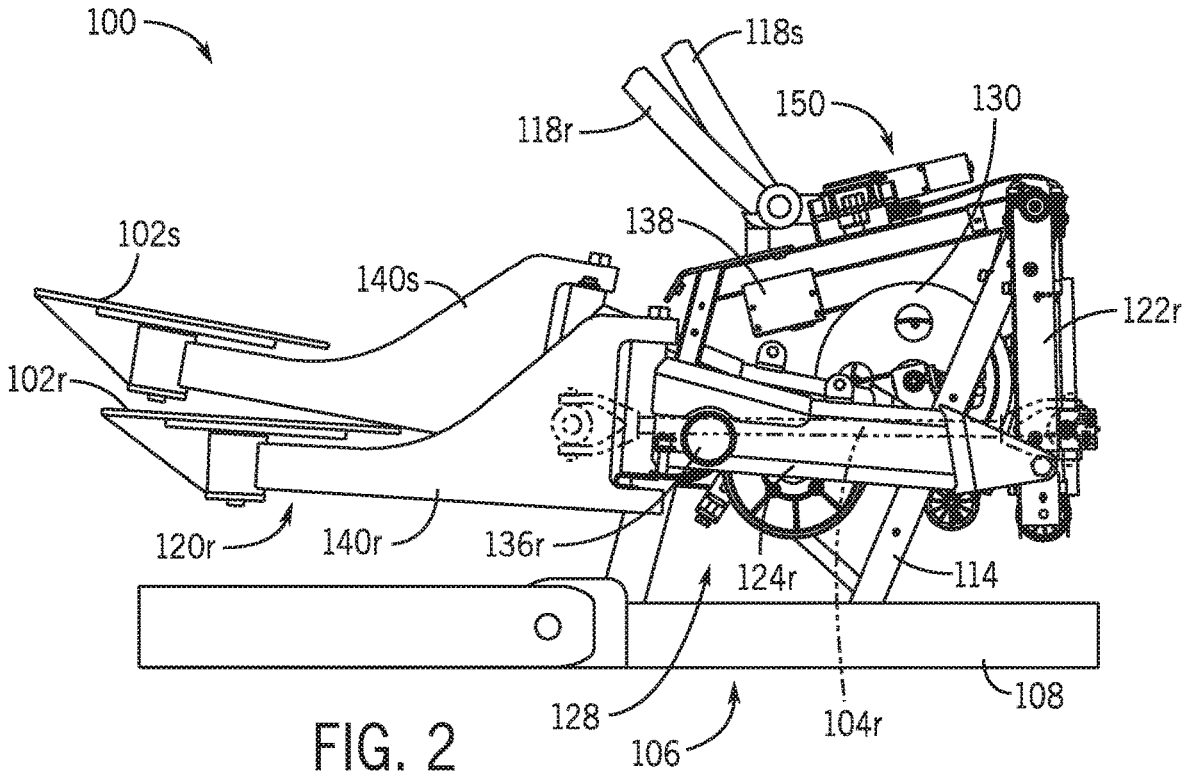
FIG. 2 is a side elevation view of the lateral elliptical trainer of FIG. 1 in accordance with various embodiments of the present disclosure.
Figure 3:
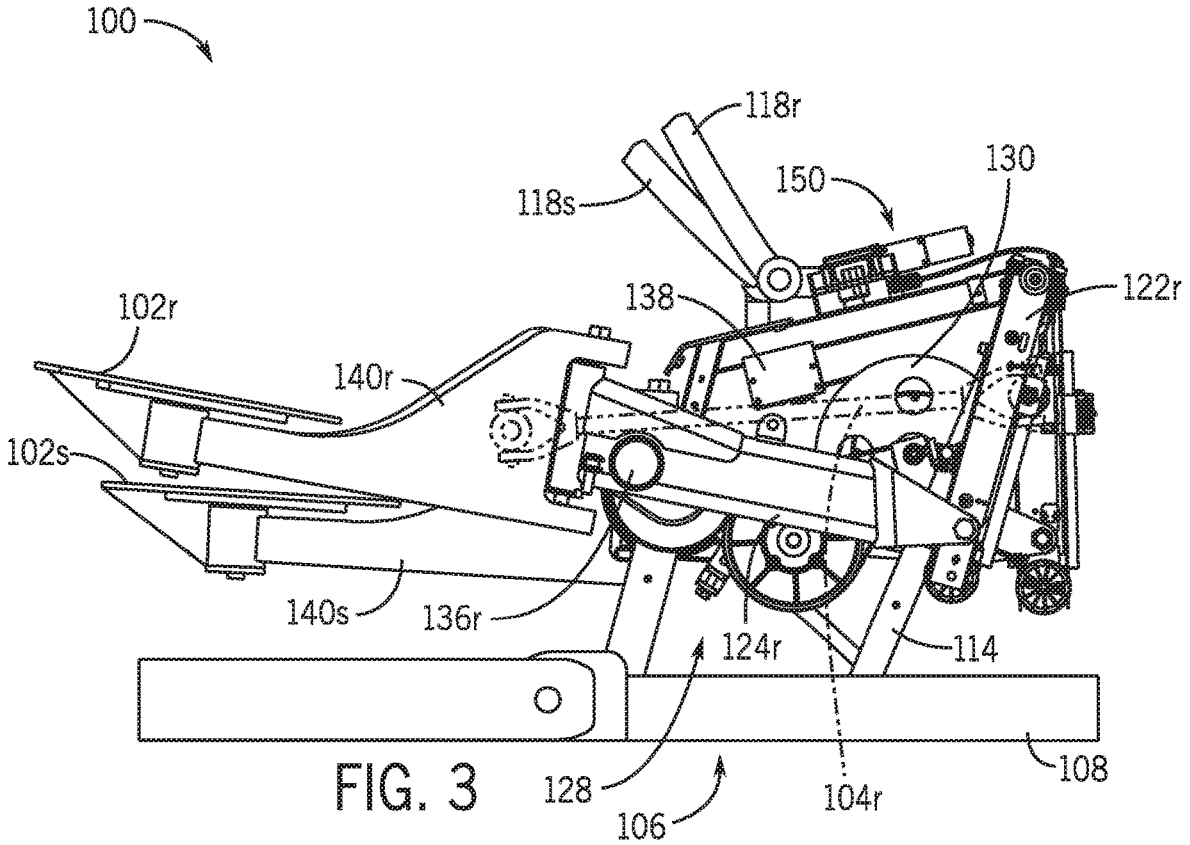
FIG. 3 is a side elevation view of the lateral elliptical trainer of FIG. 1, but with a lateral linkage in a different position relative to FIG. 2 to alter lateral displacement of a foot support platform in accordance with various embodiments of the present disclosure.

FIG. 1 is an isometric view of an exercise machine or lateral elliptical trainer 100 in accordance with an embodiment of the present disclosure. FIGS. 2 and 3 are side elevation views of the lateral elliptical trainer 100 that illustrate the foot support platforms in different positions.

As can be seen in FIGS. 1-3, the lateral elliptical trainer 100 may include and right and left foot support platforms 102*r*, 102*s* (collectively foot support platforms 102), on which a user stands when operating the lateral elliptical trainer 100. In operation, the foot support platforms 102 may move through a closed-loop path of travel that is defined at least in part by right and left lateral linkages 104*r* and 104*s* (collectively lateral linkages 104) and other linkages, drawbars, and components coupled to the foot support platforms 102.

The closed-loop path of travel includes reciprocating movement of the foot support platforms 102 forward and rearward in a longitudinal direction along a center line of the lateral elliptical trainer 100, and movement of the foot support platforms 102 up and down in a vertical direction perpendicular to the center line of the machine. The foot support platforms 102 may additionally move in a lateral direction outward and inward relative to a longitudinal center line of the lateral elliptical trainer 100. Movement of the foot support platforms 102 along their respective closed-loop paths of travel may be 180 degrees out of phase. That is, when the left foot support platform 102*s* is at the "top" of its path of travel where it is displaced to its greatest extent in the vertical direction, the right foot support platform 102*r* may be at the "bottom" of its path of travel where it is displaced to its least extent in the vertical direction. Similarly, when the right foot support platform 102*r* is at the top of its path of travel, the left foot support platform 102*s* may be at the bottom of its path of travel. The foot support platforms 102 may travel along a closed-loop path of minimal length when the foot support platforms 102 move primarily backwards and forwards in the longitudinal direction of the trainer 100 and up and down in the vertical direction, with little or no movement outwardly and inwardly in the lateral direction. The greater the foot support platforms 102 move outwardly and inwardly in the lateral direction, generally the greater the length of the closed-loop path taken by the foot support platforms 102.

With continued reference to FIGS. 1-3, the lateral elliptical trainer 100 may include a frame 106 that supports the various components of the lateral elliptical trainer 100. The frame 106 may include a base 108 for stably supporting the lateral elliptical trainer 100 on a floor or other surface, and the base 108 may include one or more base members, such as cross members 110 and stabilizer arms 112. The frame 106 may include one or more upright posts 114 that are fixedly coupled to the base 108. The frame 106 may support various exercise machine components discussed herein through fixed and/or movable couplings to the frame components, such as the base 108 and/or the one or more posts 114. In addition to the components specifically described, the frame 106 may include other stiles, rails, stanchions, and other supporting members (not separately numbered) as appropriate to operably support the components of the lateral elliptical trainer 100.

The frame 106 may be understood as defining lateral, longitudinal, and vertical directions, and the following discussion may reference various geometric planes that are defined by the lateral, longitudinal, and/or vertical directions. By way of example, the lateral direction and the longitudinal direction define a horizontal plane, the longitudinal direction and the vertical direction define a vertical plane that extends in the longitudinal direction, and the lateral direction and the vertical direction define a vertical plane that extends in the lateral direction. The lateral, longitudinal, and vertical directions and the geometric planes may be referred to herein in the course of describing the orientation and/or relative motion of various components of the lateral elliptical trainer 100.

The position of the user as the user stands on the foot support platforms 102 may be understood to define additional directional descriptors used herein, such as "forward," "front," "rearward," "rear," "backward," "back," "outward," "outwardly," "right side," and "left side." As used herein, when the user stands on the foot support platforms 102, the user generally faces in a "forward" direction. The foot support platforms 102 may thus be generally arranged at the "rear" or "back" of the lateral elliptical trainer 100. Those components of the lateral elliptical trainer 100 that are proximate to the user along the longitudinal axis are generally located at the "rear" or "back" of the lateral elliptical trainer 100. Those components of the lateral elliptical trainer 100 that are distally located with respect to the user along the longitudinal axis are generally located at the "front" of the lateral elliptical trainer 100. A movement towards the front of the exercise machine in the longitudinal direction may be described as a "forward" movement. A movement away from the front of the exercise machine in the longitudinal direction may be described as a "backward" or "rearward" movement. A movement to the left or right along the lateral direction of the trainer 100 may be described as a "leftward" or "rightward" movement, respectively, or generally a "lateral" or "outward" movement.

Referring still to FIGS. 1-3, the lateral elliptical trainer 100 may include right and left handlebars 118*r*, 118*s* (collectively handlebars 118). During operation of the lateral elliptical trainer 100, a user may stand on the foot support platforms 102 and grip the right handlebar 118*r* with a right hand and grip the left handlebar 118*s* with a left hand. The foot support platforms 102 and the handlebars 118 may be configured to move together during operation of the lateral elliptical trainer 100. As described in greater detail below, the foot support platforms 102 may move along a closed-loop path, while the handlebars 118 may correspondingly reciprocate back and forth, such as by pivoting with respect to their respective connection points to the frame 106. The user may or may not grip the handlebars 118 during use of the lateral elliptical trainer 100.

The lateral elliptical trainer 100 may include right and left linkage assemblies or systems 120*r*, 120*s* (collectively linkage systems 120) that couple the foot support platforms 102 to the frame 106. The linkage systems 120 may facilitate coordinated motion between the foot support platforms 102 and the handlebars 118. The linkage systems 120 may be an assembly of link members coupled together to move relative to one another.

The right and left linkage systems 120*r*, 120*s* may include right and left rocker arms 122*r*, 122*s* (collectively rocker arms 122), respectively, and each rocker arm 122 may include an elongated body having an upper portion pivotally coupled to the frame 106 at pivot axis P1 (see FIG. 1). The pivot axis P1 may extend in the lateral direction of the trainer 100. The rocker arms 122 may be located on right and left sides at the front portion of the lateral elliptical trainer 100 and each may include an elongated body that extends generally downward from the pivot axis P1. As illustrated in FIG. 1, the upper end of each rocker arm 122 may be pivotally coupled to the one or more posts 114 of the frame 106 at pivot axis P1. Lower portions of the rocker arms 122 may move forward and rearward (e.g., swing) through a range of motion relative to the upper portions of the rocker arms 122. Because the pivot axis P1 generally extends in the lateral direction, the rocking back and forth of the rocker arms 122 generally includes motion in the longitudinal and vertical directions, but not in the lateral direction.

The right and left linkage systems 120*r*, 120*s* may include right and left foot links 124*r*, 124*s* (collectively foot links 124), respectively, and each foot link 124 may include an elongated body having a forward portion that is pivotally coupled to the lower portion of a respective rocker arm 122 and a rearward portion that is distal from the forward portion. As can be seen in FIG. 1, the foot links 124 extend generally rearward in the longitudinal direction away from the lower portions of the rocker arms 122. The foot links 124 may be configured to translate forward and rearward relative to the frame 106. The range of motion through which the foot links 124 move may be established, at least in part, by the coupling to the rocker arms 122. The range of motion through which the foot links 124 move may additionally be established by a coupling to an inertial system 128 that includes a flywheel 130 configured to rotate with a drive shaft 132 arranged at the center of the flywheel 130. The drive shaft 132 may be supported by the frame 106 for rotation about a rotation axis that extends through the center of the drive shaft 132 in the lateral direction. The flywheel 130 and the drive shaft 132 may be coupled with right and left crank arms 134*r*, 134*s* (collectively crank arms 134) via one or more pulleys and belts, for example, and the crank arms 134 may be rotatably coupled to intermediate points on the foot links 124 via right and left rotatable couplings 136*r*, 136*s* (collectively rotatable couplings 136), for example. As illustrated in FIGS. 2 and 3, the lateral elliptical trainer 100 may include a resistive system 138 for providing a controlled variable resistive force, such as a brake and braking control system. The resistive system 138 may be supported by the frame 106 and may be operatively coupled to the foot links 124 via the flywheel 130, for example. The user may engage the resistive system 138 to slow the motion of the foot support platforms 102 by slowing the motion of the foot links 124 and/or the motion of the flywheel 130.

As mentioned, the range of motion through which the foot links 124 move may be established, at least in part, by the motion of the rocker arms 122 and the crank arms 134. Referring to FIGS. 2 and 3, as the right rocker arm 122*r* swings back and forth, the foot link 124*r* moves back and forth in a generally longitudinal direction along with the lower portion of the right rocker arm 122*r*. This motion of the foot link 124*r* turns the crank arm 134*r* (see FIG. 1) via the rotatable coupling 136*r* so as to drive the flywheel 130. The rotatable coupling 136*r* that connects the foot link 124*r* to the crank arm 134*r* moves along a closed-loop path that has a generally circular shape defined by the effective length of the crank arm 134*r*. In order for the rotatable coupling 136*r* to follow this circular path, the foot link 124*r* undergoes some displacement in the vertical direction as it moves back and forth in the longitudinal direction. The foot link 124*r* reaches a high point when the rotatable coupling 136*r* is at a high point along its closed-loop circular path. Similarly, the foot link 124*r* is at a low point when the rotatable coupling 136*r* is at a low point along its closed-loop circular path. Because the right and left crank arms 134*r*, 134*s* generally extend in opposite directions relative to each other, when the right foot link 124*r* is at a high point, the left foot link 124*s* is at a low point. Similarly, when the left foot link 124*s* is at a high point, the right foot link 124*r* is at a low point.

As illustrated in FIG. 1, the lateral elliptical trainer 100 may include right and left handlebar linkages 142*r* and 142*s* (collectively handle bar linkages 142). The handlebar linkages 142 may be configured to couple the handlebars 118 to the foot links 124. The handlebars 118 generally may be configured to rock back and forth with respect to their connection point to the frame 106 as the user operates the lateral elliptical trainer 100. Example handlebar linkages that may be used with the lateral elliptical trainer 100 are disclosed in U.S. Pat. No. 9,364,707.

The linkage system 120 may include right and left lateral glide links 140*r*, 140*s* (collectively lateral glide links 140). As illustrated in FIG. 1, each lateral glide link 140 may include an elongated body having a forward portion that is pivotally coupled to the rearward portion of the respective foot link 124 at pivot axis P2 and a rearward portion located distally from the forward portion and coupled to the respective foot support platform 102. The lateral glide links 140 may be configured to translate back and forth through a range of motion that is coordinated with the reciprocating motion of the foot links 124. For example, the lateral glide links 140 may generally move in a vertical plane without any lateral movement component. In addition to longitudinal and vertical movement, the lateral glide links 140 may pivot about pivot axis P2, which generally extends in a vertical direction, to enable lateral movement of the lateral glide links 140. For example, the rearward portions of the glide links 140 may swing in lateral directions relative to the forward portions of the glide links 140, which are coupled to the foot links 124 at pivot axis P2. As illustrated in FIG. 1, the rearward portions of the lateral glide links 140 may be coupled to the foot support platforms 102. In some configurations, the foot support platforms 102 are pivotally coupled to the lateral glide links 140 such that the foot support platforms 102 can pivot with respect to the glide links 140 so as to maintain proper alignment of the user's feet as the lateral glide links 140 are positioned at various different angular orientations with respect to the foot links 124.

The lateral linkages 104 may be moveable into different orientations to alter the amount of lateral motion in the closed-loop path taken by the foot support platforms 102. Depending on the configuration of the lateral linkages 104, the amount of lateral displacement set by the user may be in a range from no to very little lateral displacement to a significant amount of lateral displacement of the foot support platforms 102. As shown in FIGS. 1-3, the forward end of each lateral linkage 104 may be pivotally coupled to a respective rocker arm 122 and the rearward end of each lateral linkage 104 may be pivotally coupled to a respective lateral glide link 140. By moving the location of the forward ends of the lateral linkages 104 relative to the respective rocker arms 122, the user can adjust the lateral position of the foot support platforms 102 via the lateral glide links 140. For example, the forward ends of the lateral linkages 104 may be moveable up and down along the length of the rocker arms 122, and the position of the forward ends of the lateral linkages 104 relative to the rocker arms 122 generally determines the extent to which the glide links 140 are pivoted in the lateral direction relative to the foot links 124. The position of the forward ends of the lateral linkages 104 along the length of the respective rocker arms 122 may be selectively set by the user to provide an amount of lateral displacement of the foot support platforms 102 relative to the foot links 124. The amount of lateral displacement is defined at least in part by the extent to which the glide links 140 pivot laterally about the pivot axis P2 (see FIG. 1) relative to the associated foot link 124. The position of the forward ends of the lateral linkages 104 is a selectively fixed position relative to the rocker arms 122 that can be adjusted by the user.

The higher the forward ends of the lateral linkages 104 are positioned along the length of the rocker arms 122, the greater extent to which the glide links 140 pivot outwardly to define a greater amount of lateral displacement of the foot support platforms 102. In FIGS. 1 and 2, the forward ends of the lateral linkage 104 are positioned at relatively high points along the length of the rocker arms 122. Thus, the glide links 140 are pivoted outwardly, defining a greater amount of lateral displacement. In FIG. 3, the forward portions of the lateral linkage 104 are positioned at relatively low points along the length of the rocker arms 122. Thus, the glide links 140 define a lesser amount of lateral displacement.

The lateral elliptical trainer 100 may be configurable to adjust the amount of lateral displacement of the foot support platforms 102 responsive to user controls. The adjustment allows the user to change the amount of lateral motion in the closed-loop path to tailor the work out. For example, the amount of lateral motion may be changed as desired during an exercise routine. As illustrated in FIGS. 1-3, the lateral elliptical trainer 100 may include a lateral adjustment or repositioning assembly or system 150 that is generally configured to move the forward ends of lateral linkages 104 up and down along the rocker arms 122 so as to adjust the extent to which the lateral glide links 140 are pivoted laterally relative to the foot links 124.

Figure 4:
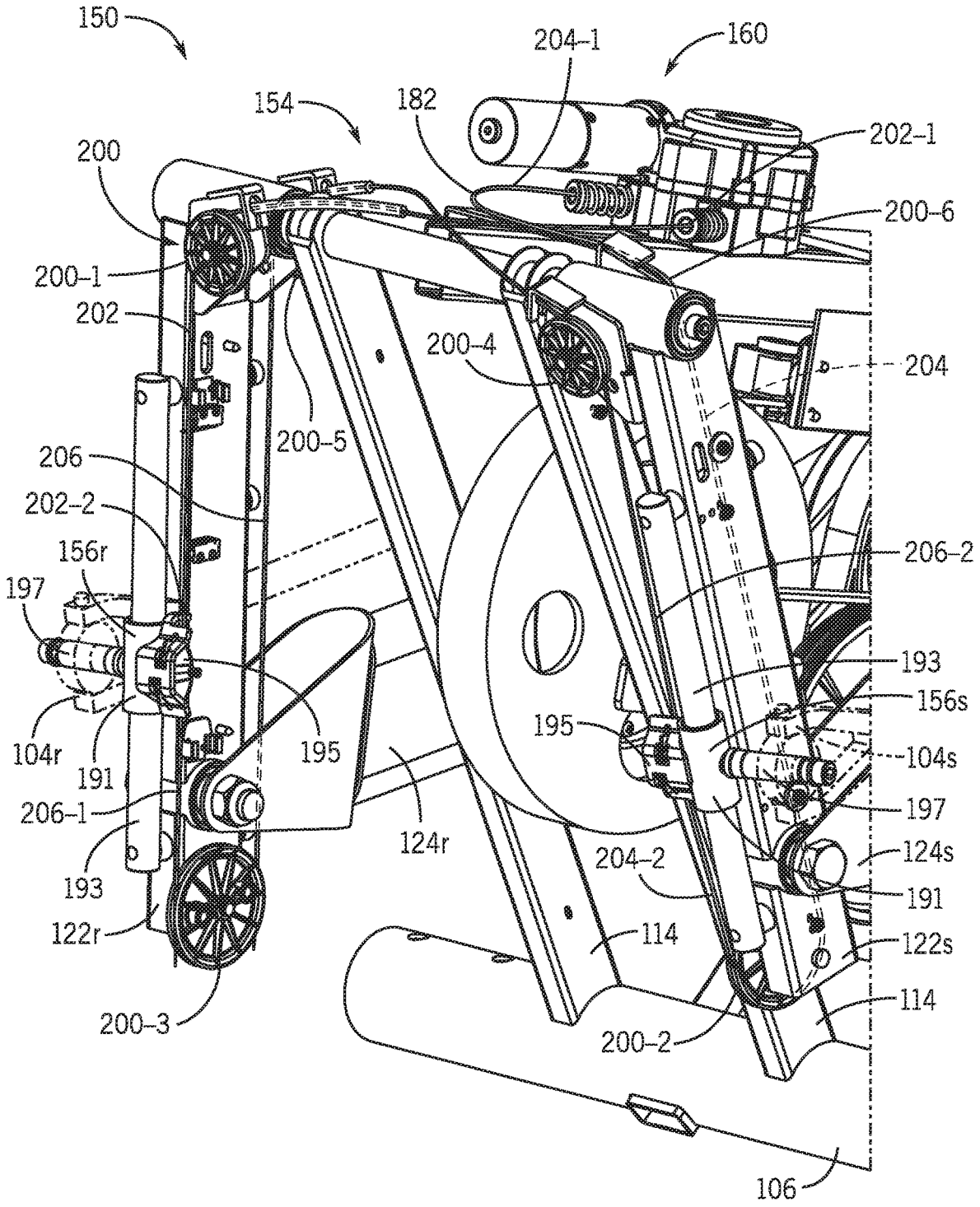
FIG. 4 is an isometric view of a lateral adjustment system of the lateral elliptical trainer of FIG. 1 in accordance with various embodiments of the present disclosure.

Referring to FIG. 4, the lateral adjustment system 150 may include a cable assembly or system 154 that is operatively coupled to the forward ends of the lateral linkages 104 to move the forward ends of the lateral linkages 104 up and down along the rocker arms 122. For example, the cable system 154 may be coupled to left and right carriages 156*s*, 156*r* (collectively carriages 156), which enable repositioning of the forward ends of the respective lateral linkages 104. The forward ends of the lateral linkages 104 may be pivotably coupled to the carriages 156, and the carriages 156 may move along the length of the associated rocker arm 122 in response to movement of the cable system 154.

As illustrated in FIG. 4, the lateral adjustment system 150 may include a cable actuator 160 coupled to the cable system 154. The cable actuator 160 may be operative to move the carriages 156 via the cable system 154 to adjust the orientation of the lateral glide links 140 and in turn adjust the amount of lateral movement of the foot support platforms 102. The cable actuator 160 may be controllable by the user to set the position of the forward ends of the lateral linkages 104. For example, the cable actuator 160 may be controlled by a user via an interface panel, which may be in communication with an onboard or remotely-located microcontroller or processor configured to control the cable actuator 160. As illustrated in FIG. 4, the cable actuator 160 may be coupled to the frame 106 of the lateral elliptical trainer 100.

Figure 5:
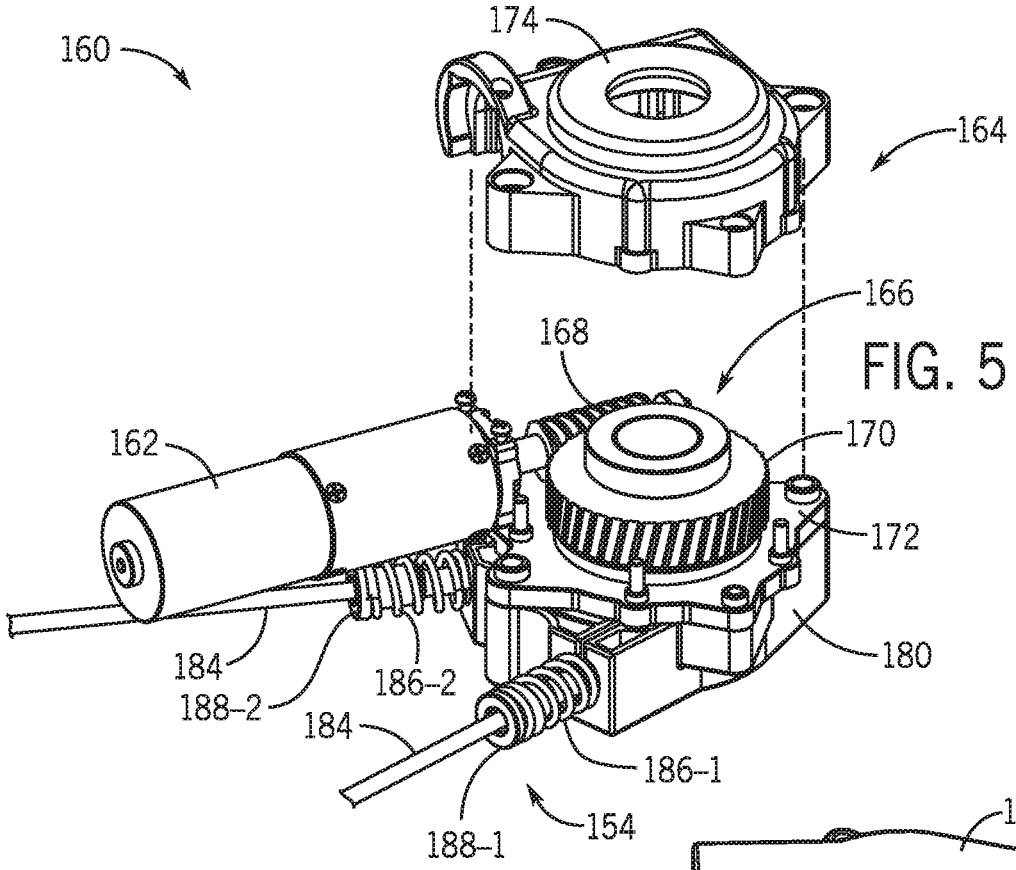
FIG. 5 is a partially exploded view of a cable actuator in accordance with various embodiments of the present disclosure.
Figure 6:
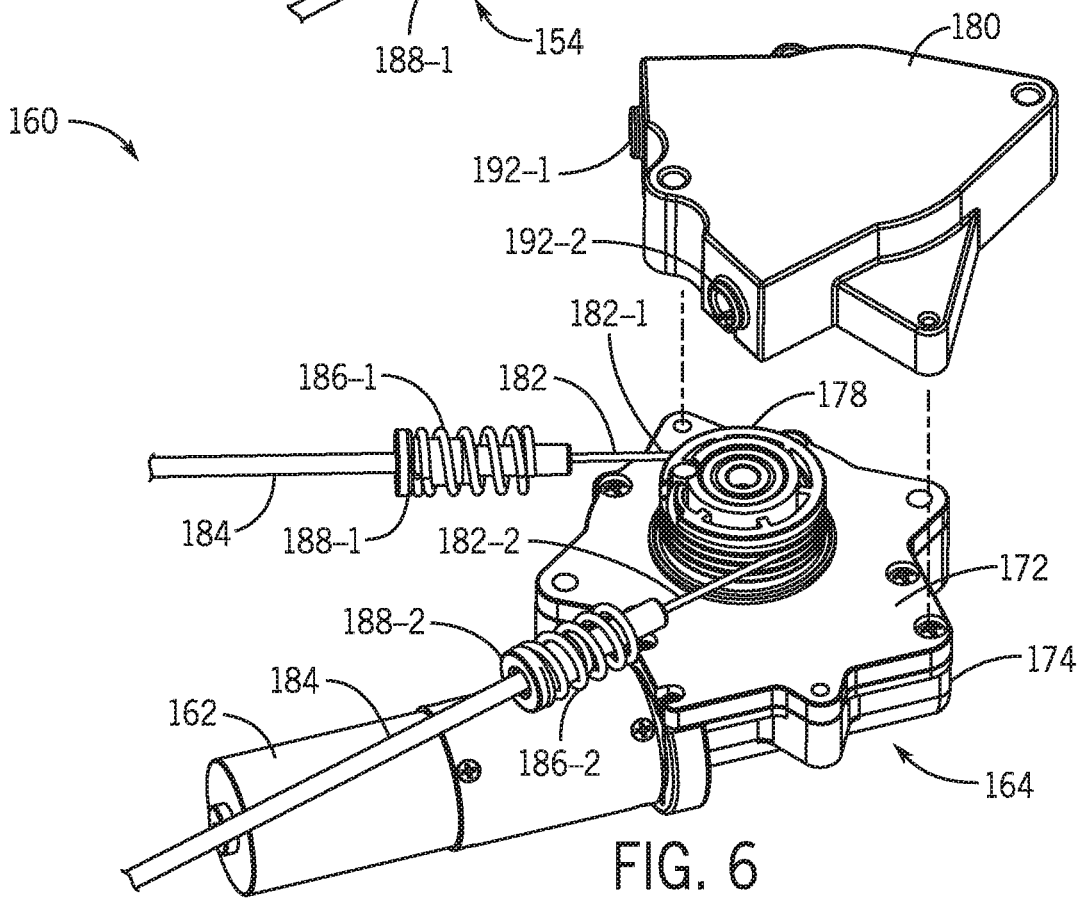
FIG. 6 is another partially exploded view of the cable actuator of FIG. 5 in accordance with various embodiments of the present disclosure.
Figure 10:
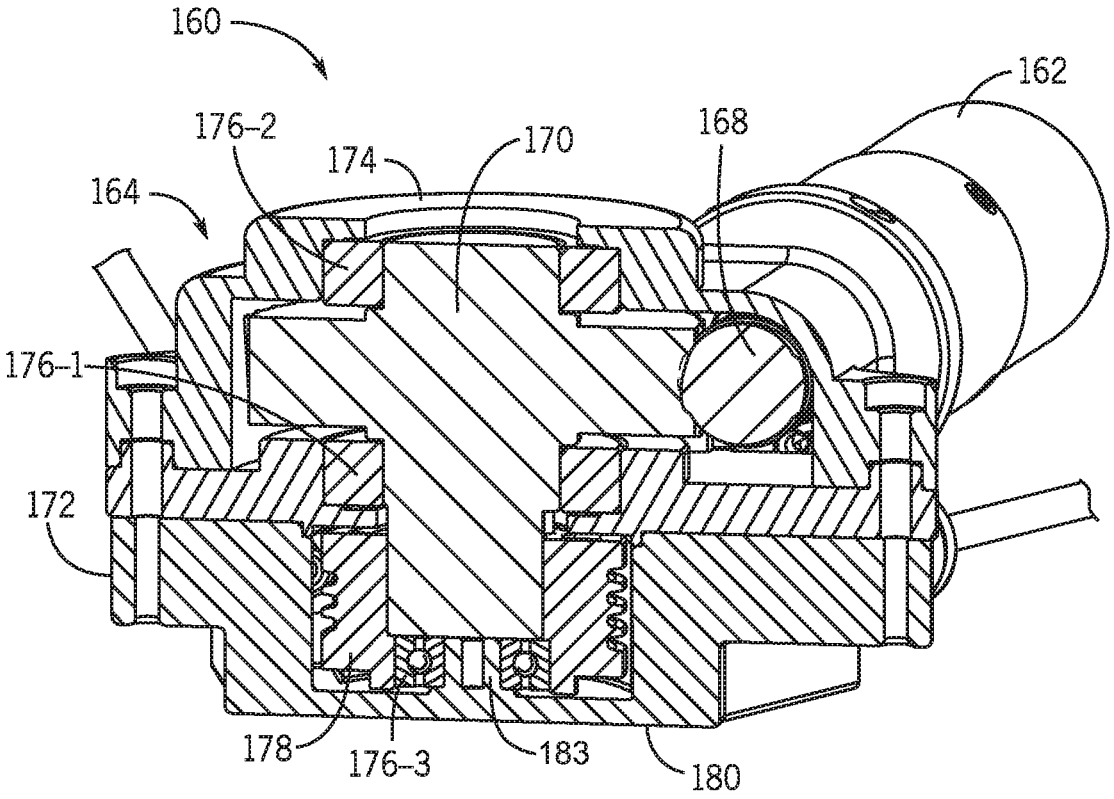
FIG. 10 is another cross-sectional view of the cable actuator of FIG. 5 in accordance with various embodiments of the present disclosure.
Figure 13:
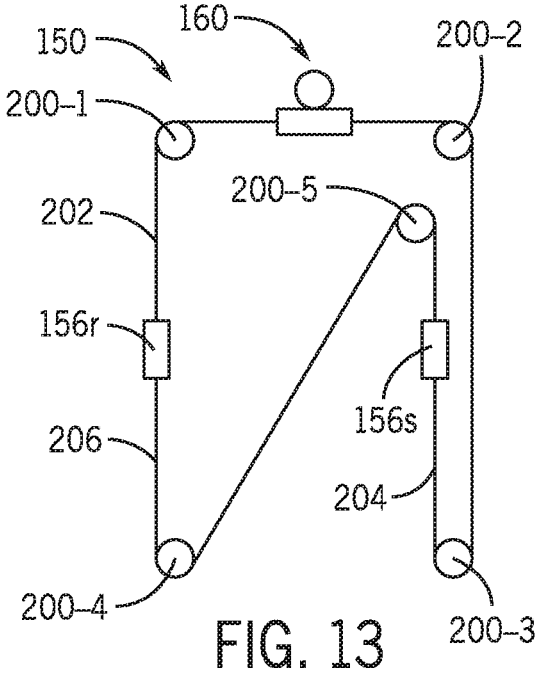
FIG. 13 is a schematic of a first alternative cable routing of the adjustment system of FIG. 4 in accordance with various embodiments of the present disclosure.

Referring to FIGS. 5, 6, and 10, the cable actuator 160 may include a drive source, such as motor 162. The motor 162 may be controlled by a user via a user interface panel, for example, which may include preprogrammed parameters for executing an exercise routine. The motor 162 may be in operative engagement with a gearbox 164. The gearbox 164 may include a gear arrangement to provide a gear reduction in a relatively compact manner, and the gear arrangement may be configured as a non-back drive gear train. As illustrated in FIG. 5, the gearbox 164 may include a worm drive 166 in which a worm 168 (also referred to as a worm screw) meshes with a worm gear 170 (also referred to as a worm wheel). The worm 168 may be coupled to a drive or output shaft of the motor 162 such that the worm 168 rotates with the drive shaft of the motor 162. Thus, during operation of the motor 162, the worm 168 rotates and drives the worm gear 170. The worm drive 166 may be configured as a non-back driving gear train such that no power is required to hold or maintain the lateral adjustment system 150 in a desired position or setting. As illustrated in FIG. 10, the worm gear 170 may be rotatably supported by a body 172 and a cover 174 of the gearbox 164. For example, bearing 176-1 may be positioned between the worm gear 170 and the body 172 and bearing 176-2 may be positioned between the worm gear 170 and the cover 174 to facilitate rotation of the worm gear 170 within the gearbox 164.

Figure 7:
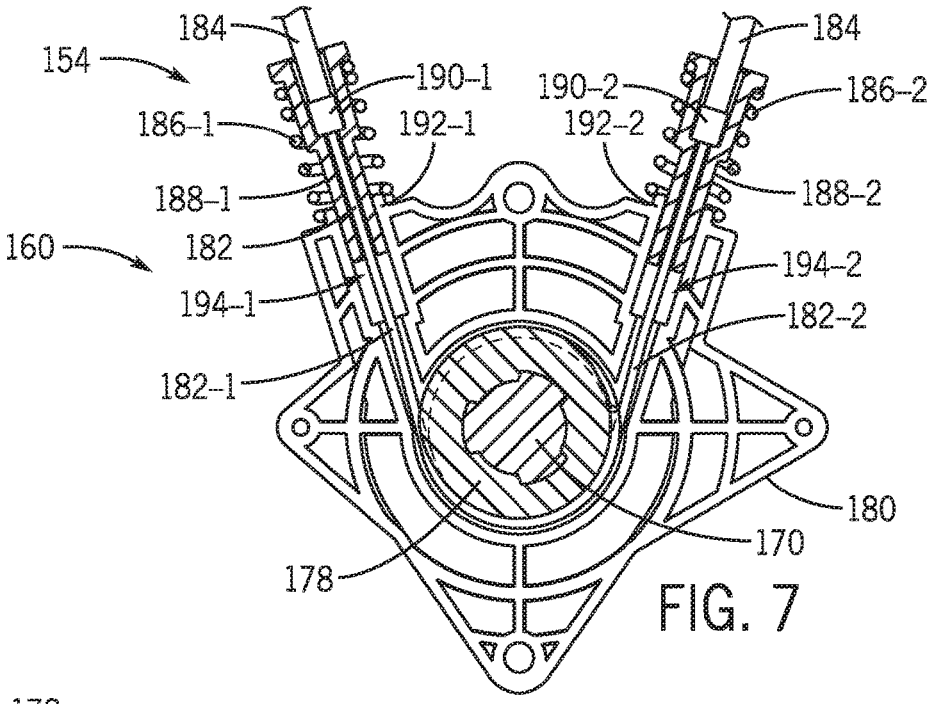
FIG. 7 is a cross-sectional view of the cable actuator of FIG. 5 in accordance with various embodiments of the present disclosure.
Figure 8:
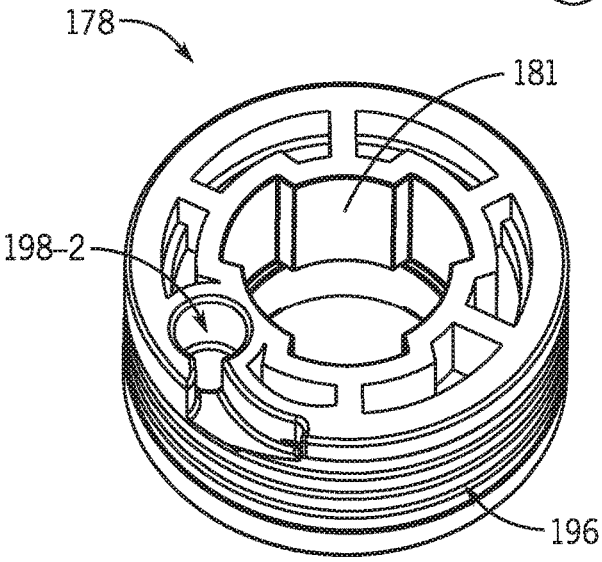
FIG. 8 is an isometric view of a drum of the cable actuator of FIG. 5 in accordance with various embodiments of the present disclosure.

With reference to FIGS. 6 and 10, the lateral adjustment system 150 may include a drum 178 operatively coupled to the motor 162 such that operation of the motor 162 causes the drum 178 to rotate. For example, as illustrated in FIGS. 6, 7, and 10, the drum 178 may be non-rotatably coupled to the worm gear 170. As illustrated in FIG. 7, the drum 178 may be axially aligned with the worm gear 170 and may be splined to the worm gear 170 such that the drum 178 rotates in unison with the worm gear 170. In one example, as illustrated in FIG. 8, the drum 178 may include inwardly-projecting splines 181 that extend lengthwise along a length of the drum 178 for engagement with corresponding grooves defined in an axial projection of the worm gear 170. The drum 178 may be rotatably supported by a drum housing 180, which may be coupled to the gearbox 164. The drum housing 180 may be coupled to the body 172 of the gearbox 164 opposite the gearbox cover 174. As illustrated in FIG. 10, the drum 178 may be positioned between the body 172 of the gearbox 164 and the drum housing 180. The drum 178 may be rotatably mounted onto a stub shaft 183 of the housing 180 via a bearing 176-3, for example. In this configuration, during operation of the motor 162, the worm 168 drives the worm gear 170 and in turn rotates the drum 178. The motor 162 may be rotatable in opposite directions to thereby rotate the drum 178 in opposite directions.

The cable system 154 may be coupled to the drum 178 such that rotation of the drum 178 causes the carriages 156 to slide along the rocker arms 122 via the cable system 154, thereby moving the front ends of the lateral linkages 104 (see FIG. 4). Referring to FIGS. 6 and 7, the cable system 154 may include a cable 182 slidably received in a cable housing or sheath 184. End portions 182-1, 182-2 of the cable 182 may be coupled to the drum 178 such that rotation of the drum 178 causes one of the end portions 182-1 or 182-2 to be wrapped around the drum 178 and the other of the end portions 182-2 or 182-1 to be unwrapped from the drum 178 depending on the rotation direction of the drum 178. The carriages 156 (see FIG. 4) may be fixedly coupled to the cable 182, and thus movement of the cable 182 via the drum 178 causes the carriages 156 to slide along the length of the rocker arms 122.

The cable system 154 may be biased to reduce the amount backlash in the system. For example, as illustrated in FIGS. 5-7, the cable system 154 may include bias springs 186-1, 186-2 (collectively bias springs 186) associated with end portions of the cable housing 184. The bias springs 186-1, 186-2 may be seated onto spring seats 188-1, 188-2 (collectively spring seats 188), respectively, and the spring seats 188 may extend between the drum housing 180 and the cable housing 184. As illustrated in FIG. 7, the spring seats 188-1, 188-2 may abut against caps 190-1, 190-2 (collectively caps 190), respectively, that are mounted onto end portions of the cable housing 184. The bias springs 186 may be seated onto the spring seats 188, and the bias springs 186 may be abutted against the drum housing 180 such that the bias springs 186 provide a force that preloads the cable housing 184 to reduce backlash in the cable system 154. For example, the bias springs 186 may be compressed between the spring seats 188 and the drum housing 180 such that the bias springs 186 force the caps 190, and thus the ends of the cable housing 184, away from the drum housing 180 to preload the cable housing 184. As illustrated in FIGS. 6 and 7, bosses 192-1, 192-2 (collectively bosses 192) may protrude from the drum housing 180 to locate ends of the bias springs 186 relative to the housing 180. Additionally or alternatively, the spring seats 188 may be received in recesses 194-1, 194-2 formed in the drum housing 180 to facilitate proper alignment of the cable system 154 to the drum housing 180.

Figure 9:
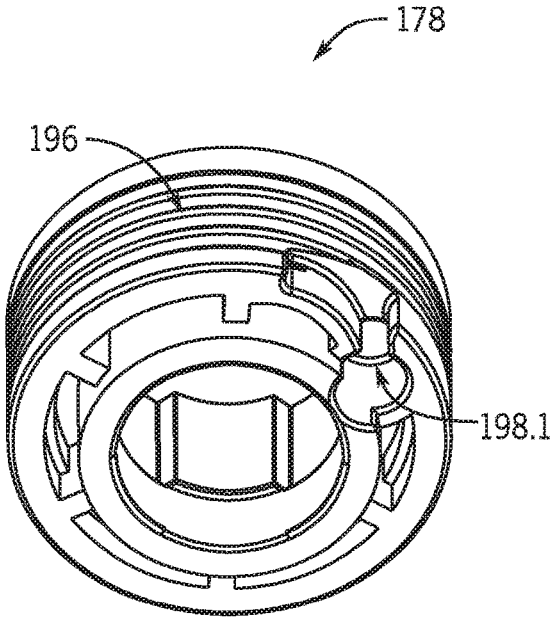
FIG. 9 is another isometric view of the drum of FIG. 8 in accordance with various embodiments of the present disclosure.

Referring to FIGS. 8 and 9, the drum 178 may be configured to facilitate wrapping of the cable 182 around the drum 178. For example, the drum 178 may include a groove 196 formed in a periphery of the drum 178. The groove 196 may extend in a spiral path and may terminate in seats 198-1, 198-2 (collectively seats 198) configured to receive and retain enlarged ends of the cable 182. As illustrated in FIGS. 8 and 9, the seats 198 may be formed in opposite ends of the drum 178. In such configuration, the end portions of the cable 182 may enter into the drum housing 180 (see FIG. 7) in a plane substantially aligned with a mid-plane of the drum 178 and be wrapped in opposite directions along the spiral groove 196, and enlarged ends of the cable 182 may be retained in the seats 198. From this nominal position, the drum 178 may be rotated in either direction to unwrap one of the end portions of the cable 182 from the periphery of the drum 178, thereby vacating a portion of the groove 196, and to wrap the other of the end portions of the cable 182 about the periphery of the drum 178, possibly occupying the vacated portion of the groove 196 depending on the amount of rotation of the drum 178.

Referring back to FIG. 4, the cable 182 may be fixedly coupled to the carriages 156 such that the carriages 156 move in unison with the cable 182. As illustrated in FIG. 4, each carriage 156 may include a tubular body 191 configured to slide along a guide rail 193 coupled to the respective rocker arm 122 and include a bracket 195 extending laterally from the tubular body 191. The cable 182 may be fixedly coupled to the bracket 195 to transfer motion from the cable 182 to the respective carriage 156. The bracket 195 may be positioned on an opposite side of the tubular body 191 than a shaft 197 configured to pivotally couple the respective lateral linkage 104 to the respective carriage 156. In various embodiments, the bracket 195 may extend laterally inward from the tubular body 191, and the shaft 197 may extend laterally outward from the tubular body 191.

The cable 182 may be routed between the right and left carriages 156*r*, 156*s* such that the carriages 156 move in substantially the same direction (e.g., up or down) during operation of the cable actuator 160 (e.g., during rotation of the drum 178). For example, when the drum 178 is rotated in one direction, the section of the cable 182 extending between the cable actuator 160 and the right carriage 156*r* may pull the right carriage 156*r* upwardly along the length of the right rocker arm 122*r*, and the section of the cable 182 extending between the right and left carriages 156*r*, 156*s* may pull the left carriage 156*s* upwardly along the length of the left rocker arm 122*s*. Similarly, when the drum 178 is rotated in an opposite direction, the section of the cable 182 extending between the cable actuator 160 and the left carriage 156*s* may pull the left carriage 156*r* downwardly along the length of the left rocker arm 122*s*, and the section of the cable 182 extending between the right and left carriages 156*r*, 156*s* may pull the right carriage 156*r* downwardly along the length of the right rocker arm 122*r*. To facilitate routing of the cable 182, the lateral adjustment system 150 may include one or more pulleys 200 about which the cable 182 is routed.

The cable 182 may comprise multiple cables that are coupled together. For example, referring to FIG. 4, a first cable 202 may extend between the right carriage 156*r* and the cable actuator 160, a second cable 204 may extend between the left carriage 156*s* and the cable actuator 160, and a third cable 206 may extend between the right carriage 156*r* and the left carriage 156*s*. The first cable 202 may include a first end portion 202-1 coupled to the cable actuator 160 and a second end portion 202-2 coupled to the right carriage 156*r*. The second cable 204 may include a first end portion 204-1 coupled to the cable actuator 160 and a second end portion 204-2 coupled to the left carriage 156*s*. The third cable 206 may include a first end portion 206-1 coupled to the right carriage 156*r* and a second end portion 206-2 coupled to the left carriage 156*s*.

The third cable 206 may be routed between the right and left carriages 156*r*, 156*s* such that the carriages 156 move in substantially the same direction (e.g., up or down) during operation of the cable actuator 160 (e.g., during rotation of the drum 178). For example, when the drum 178 is rotated in one direction, the first cable 202 may pull the right carriage 156*r* upwardly along the length of the right rocker arm 122*r*, and in turn the third cable 206 may pull the left carriage 156*s* upwardly along the length of the left rocker arm 122*s*. Similarly, when the drum 178 is rotated in an opposite direction, the second cable 204 may pull the left carriage 156*r* downwardly along the length of the left rocker arm 122*s*, and in turn the third cable 206 may pull the right carriage 156*r* downwardly along the length of the right rocker arm 122*r*.

The cables 202, 204, 206 may be routed around the one or more pulleys 200 in a particular configuration to provide a synchronized movement of the carriages 156. For example, as illustrated in FIG. 4, the first cable 202 may be routed around a first pulley 200-1 positioned between the cable actuator 160 and the right carriage 156*r*. The second cable 204 may be routed around a second pulley 200-2 positioned between the cable actuator 160 and the left carriage 156*s*. The third cable 206 may be routed around a third pulley 200-3 and a fourth pulley 200-4 positioned between the right and left carriages 156*r*, 156*s*. To facilitate upward and downward movement of the right carriage 156*r* along the length of the right rocker arm 122*r*, the first pulley 200-1 may be coupled to an upper end portion of the right rocker arm 122*r* and the third pulley 200-3 may be coupled to a lower end portion of the right rocker arm 122*r*. Similarly, to facilitate upward and downward movement of the left carriage 156*s* along the length of the left rocker arm 122*s*, the second pulley 200-2 may be coupled to a lower end portion of the left rocker arm 122*s* and the fourth pulley 200-4 may be coupled to an upper end portion of the left rocker arm 122*s*. As illustrated in FIG. 4, the lateral adjustment system 150 may include a fifth pulley 200-5 positioned between the right and left carriages 156*r*, 156*s* and a sixth pulley 200-6 positioned between the cable actuator 160 and the left carriage 156*s* to facilitate routing of the cables from the cable actuator 160 and along the rocker arms 122.

FIGS. 13-16 illustrate alternative cable routing arrangements of the lateral adjustment system 150. Each configuration has different power requirements, and a balance between system performance and packaging may determine which cable routing arrangement is used for a particular application. In the arrangement illustrated in FIG. 13, the lateral adjustment system 150 includes five pulleys. The first cable 202 is routed around a first pulley 200-1 located between the cable actuator 160 and the right carriage 156*r*, the second cable 204 is routed around a second pulley 200-2 and a third pulley 200-3 located between the cable actuator 160 and the left carriage 156*s*, and the third cable 206 is routed around fourth and fifth pulleys 200-4, 200-5 located between the right and left carriages 156*r*, 156*s*.

Figure 14:
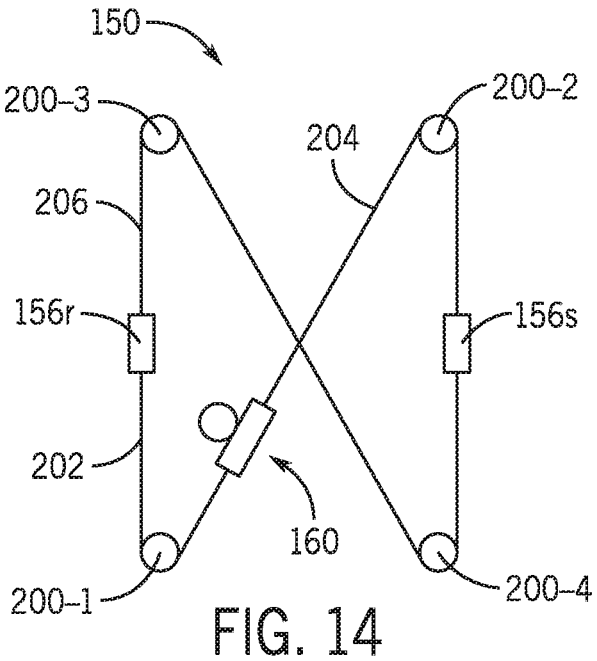
FIG. 14 is a schematic of a second alternative cable routing of the adjustment system of FIG. 4 in accordance with various embodiments of the present disclosure.

In the arrangement illustrated in FIG. 14, the lateral adjustment system 150 includes four pulleys. The first cable 202 is routed around a first pulley 200-1 located between the cable actuator 160 and the right carriage 156*r*, the second cable 204 is routed around a second pulley 200-2 located between the cable actuator 160 and the left carriage 156*s*, and the third cable 206 is routed around third and fourth pulleys 200-3, 200-4 located between the right and left carriages 156*r*, 156*s*. The arrangement illustrated in FIG. 14 generally is more efficient in transferring motion of the cable actuator 160 to the carriages 156 than the arrangements illustrated in FIGS. 13, 15, and 16.

Figure 15:
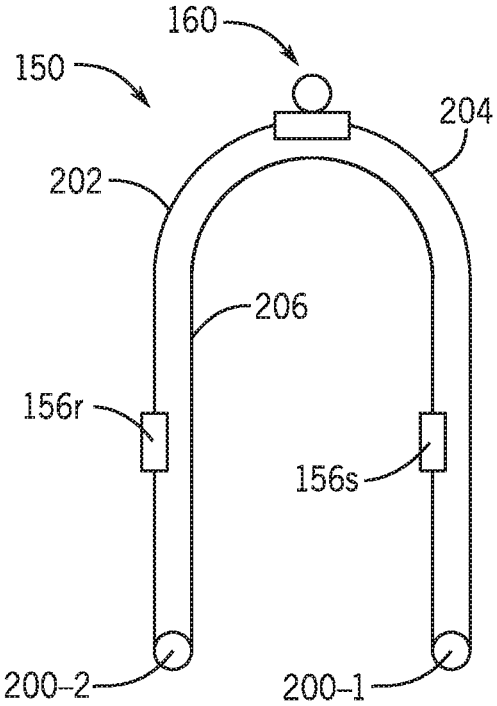
FIG. 15 is a schematic of a third alternative cable routing of the adjustment system of FIG. 4 in accordance with various embodiments of the present disclosure.

In the arrangement illustrated in FIG. 15, the lateral adjustment system 150 includes two pulleys. The first cable 202 is routed between the cable actuator 160 and the right carriage 156*r* without the use of a pulley, the second cable 204 is routed around a first pulley 200-1 located between the cable actuator 160 and the left carriage 156*s*, and the third cable 206 is routed around a second pulley 200-2 located between the right and left carriages 156*r*, 156*s*. The arrangement illustrated in FIG. 15 generally is less efficient in transferring motion of the cable actuator 160 to the carriages 156 than the arrangements illustrated in FIGS. 13, 14, and 16.

Figure 16:
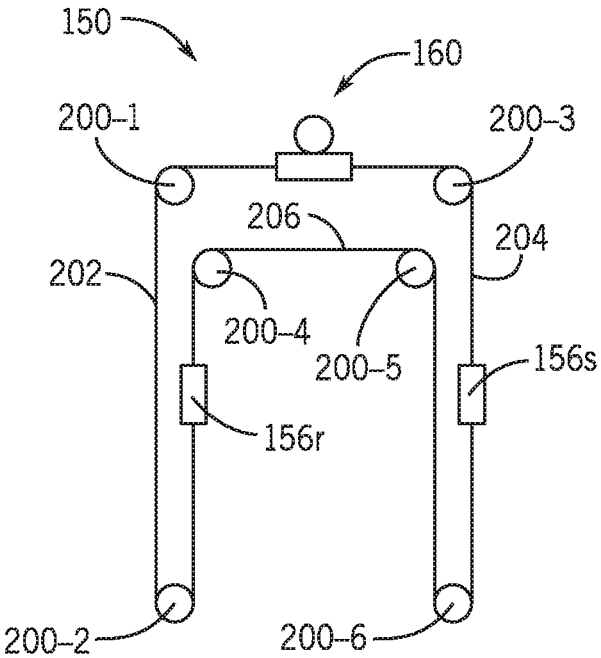
FIG. 16 is a schematic of a fourth alternative cable routing of the adjustment system of FIG. 4 in accordance with various embodiments of the present disclosure.

In the arrangement illustrated in FIG. 16, the lateral adjustment system 150 includes six pulleys. The first cable 202 is routed around first and second pulleys 200-1, 200-2 located between the cable actuator 160 and the right carriage 156*r*, the second cable 204 is routed around a third pulley 200-3 located between the cable actuator 160 and the left carriage 156*s*, and the third cable 206 is routed around fourth, fifth, and sixth pulleys 200-4, 200-5, 200-6 located between the right and left carriages 156*r*, 156*s*. The arrangement illustrated in FIG. 16 generally is more efficient than the arrangements illustrated in FIGS. 13 and 15 but less efficient than the arrangement illustrated in FIG. 14 in transferring motion of the cable actuator 160 to the carriages 156.

Referring to FIGS. 11 and 12, the lateral adjustment system 150 may include position sensing to determine the location of the carriages 156. Position sensing of the lateral adjustment system 150 is less complex and costly than typical lateral elliptical trainers because independent position tracking of the carriages 156 is not required as the carriages 156 are mechanically coupled together via one or more cables. Because the carriages 156 are mechanically connected together, position sensing can be done at any point in the system. For example, position sensing of the lateral adjustment system 150 can be achieved by monitoring the motor 162, the gearbox 164, the drum 178, either or both of the carriages 156, or the cable 182 (e.g., the first cable 202, the second cable 204, and/or the third cable 206).

In various embodiments, a position sensor is coupled to one of the rocker arms 122 and is configured to detect the position of the associated carriage. For example, as illustrated in FIG. 12, a potentiometer 210 may be coupled to the left rocker arm 122*s* to detect the absolute position of the left carriage 156*s*, and a slide 212 may facilitate detection by the potentiometer 210. The slide 212 may include a sleeve 214 coupled to the potentiometer 210 and an arm 216 coupled to the left carriage 156*s* such that the arm 216 telescopes into or out of the sleeve 214 as the distance between the potentiometer 210 and the carriage 156*s* varies during movement of the carriage 156*s* along the length of the rocker arm 122*s*. Additionally, as the carriage 156*s* moves along the length of the rocker arm 122*s*, the arm 216 pivots the sleeve 214 to rotate a rotating contact of the potentiometer 210. Based on the rotational position of rotating contact of the potentiometer 210, the lateral adjustment system 150 can determine the absolute position of the carriage 156*s*, and thus of the foot support platforms 102.

In some embodiments, the lateral adjustment system 150 includes limit switches configured to deactivate the lateral adjustment system 150 in response to actuation of one of the limit switches. As illustrated in FIG. 11, upper and lower limit switches 220-1, 220-2 (collectively limit switches 220) may be coupled to the right rocker arm 122*r*, for example. The limit switches 220 may be positioned along the rocker arm 122*r* such that the carriage 156*r* does not actuate either of the limit switches 220 during normal operation of the lateral adjustment system 150. However, if the carriage 156*r* travels beyond its nominal travel range along the length of the rocker arm 122*r*, then the carriage 156*r* is configured to actuate the associated limit switch 220, thereby deactivating the lateral adjustment system 150.

In operation, the user stands on the foot support platforms 102 when operating the lateral elliptical trainer 100. While standing on the foot support platforms 102, the user may engage the lateral elliptical trainer 100 by moving the foot support platforms 102 through a closed-loop path of travel. The closed-loop path of travel taken by the foot support platforms 102 may be defined by the various linkages, drawbars, and other components described herein that are coupled, directly or indirectly, to the foot support platforms 102. An inertial system such as flywheel 130 may provide a mechanical load that opposes the movement of the foot support platforms 102 along their closed-loop path of travel and may impart up/down and forward/back movement to the foot links 124 through the rotatable couplings 136. The foot links 124 may translate back and forth through a range of motion that is in part defined in the longitudinal and vertical directions by the coupling of the forward portions of the foot links 124 to the lower portions of the rocker arms 122, and by the coupling of the foot links 124 to the crank arms 134. The crank arms 134 may be disposed in opposing angular positions, such as 180 degrees from each other. A resistive system 138 may provide user actuated braking of the motion of the flywheel 130 or other inertial system. By working against the action of these inertial 130 and/or resistive 136 components, the user experiences an athletic exertion as the user moves the foot support platforms 102 along the closed-loop path of travel.

The closed-loop path of travel taken by the foot support platforms 102 includes movement of the foot support platforms 102 backwards and forwards in the longitudinal direction, up and down in the vertical direction, and to various extents outward and inward in the lateral direction. This back and forth and up and down movement of the foot support platforms 102 is generally defined by linkage systems 120, which are generally configured to moveably couple the foot support platforms 102 to the frame 106. The linkage systems 120 generally include the rockers arms 122, foot links 124, and glide links 140 as described herein. The rocker arms 122 generally rock back and forth through a range of motion that is in part defined in the longitudinal and vertical directions by rotating about pivot axis P1.

The foot support platforms 102 additionally may move outward and inward in the lateral direction. Movement of the foot support platforms 102 in the lateral direction may be supported by the linkage systems 120, which define a range of motion in which the foot support platforms 102 may move inwardly and outwardly with respect to the lateral elliptical trainer 100. The amount of lateral movement depends on the location of the front portion of the lateral linkage 104 along the length of the respective rocker arm 122. The lateral elliptical trainer 100 may be configurable to set the amount of lateral displacement for the foot support platforms 102. For example, the lateral linkage 104 may be moveable relative to the rocker arm 122 into different orientations that add a lateral motion component to the closed-loop path taken by the foot support platforms 102. The forward portions of the lateral linkages 104 may be moveable up and down along a portion of the rocker arms 122 so to control the extent to which the glide links 140 pivot laterally about the pivot axes P2 relative to the associated foot link 124. The foot support platforms 102 may travel along a closed-loop path having little or no lateral movement and primarily move backwards and forwards in the longitudinal direction and up and down in the vertical direction when the front portion of the lateral linkage 104 is located at or near the bottom portion of the rocker arm 122. In some configurations, when the forward portions of the lateral linkages 104 are positioned at low points along the length of the rocker arms 122, the glide links 140 are positioned generally inwardly and in line with the foot link 124 and glide link 140. The foot support platforms 102 may travel along a closed loop path having greater amounts of lateral movement and longitudinal and vertical movement as the forward portion of the lateral linkage 104 is moved higher on the rocker arm 122. When the forward portions of the lateral linkages 104 are positioned at locations closer to the pivot axis P1, the glide links 140 may be moved laterally outward. The forward portions of the lateral linkages 104 may be moveable along the rocker arms 122 during operation of the lateral elliptical trainer 100.

Through positioning of the lateral linkages 104, the foot support platforms 102 may travel outwardly in the lateral direction as the foot support platforms 102 move from the top of the closed-loop path to the bottom of the closed-loop path. Conversely, the foot support platforms 102 may travel inwardly in the lateral direction as the foot support platforms 102 move from the bottom of the closed-loop path to the top of the closed-loop path. This lateral motion component may not be present in the closed-loop path taken by the foot support platforms 102 when the glide links 140 are positioned in line with the foot link 124.

In operation, the user may adjust the lateral displacement or movement of the foot support platforms 102 via the cable actuator 160. For example, the user may interact with a user interface (e.g., press a button, turn a dial, move a slider, etc.) to select the desired amount of lateral displacement of the foot support platforms 102. In various embodiments, the user may select a preprogrammed exercise routine which includes various settings for the lateral displacement of the foot support platforms 102.

After setting the desired lateral displacement of the foot support platforms 102, the lateral adjustment system 150 may activate the motor 162 to drivingly rotate the worm 168, thereby rotating the drum 178 via the worm gear 170. Rotation of the drum 178 generally causes one end portion of the cable 182 to be wrapped around the drum 178 and the other end portion of the cable 182 to be unwrapped from the drum 178, thereby causing the carriages 156 to move along the length of the rocker arms 122 via the cable 182. The drum 178 may be rotated in either direction by the motor 162 to move the carriages 156 in the desired direction along the length of the rocker arms 122.

As previously discussed, the forward end portions of the lateral linkages 104 may be pivotally coupled to the carriages 156, and thus cable-driven movement of the carriages 156 causes the forward end portions of the lateral linkages 104 to correspondingly move along the length of the rocker arms 122. The cable 182 may be routed from the cable actuator 160, along the rocker arms 122, and back to the cable actuator 160 in such a configuration that ensures simultaneous movement of the carriages 156 in the same direction (e.g., upward or downward). Such cable routing provides a coordinated movement of the forward ends of the lateral linkages 104 in a vertical direction, which in turn causes the foot support platforms 102 to move outward or inward via the lateral glide links 140 in a coordinated manner.

The position of the carriages 156 can be determined using a position sensor coupled to a single rocker arm 122. For example, the absolute position of the carriages 156 can be determined using a single potentiometer 210 coupled to a single rocker arm 122, because the carriages 156 are coupled together via a cable. For safety purposes, limit switches 220 may be coupled to a single rocker arm 122 to deactivate the lateral elliptical trainer 100 in response to the respective carriage 156 actuating one of the switches 220.

The one or more cables described herein offer the flexibility to handle the independent motion of each side of the lateral elliptical trainer 100 in a less expensive, lighter, and/or less complex manner than conventional adjustment systems. In various embodiments, the one or more cables can be attached directly to the carriages 156, enabling the use of a single cable actuator 160 to control the position of the carriages 156. Additionally, backlash in the lateral adjustment system 150 can be reduced with bias springs 186. In various embodiments, the carriages 156 are mechanically coupled together via the one or more cables, thereby reducing the complexity of position sensing because independent position tracking of each side of the lateral elliptical trainer 100 is not required.

The foregoing description has broad application. The discussion of any embodiment is meant only to be explanatory and is not intended to suggest that the scope of the disclosure, including the claims, is limited to these examples. In other words, while illustrative embodiments of the disclosure have been described in detail herein, the inventive concepts may be otherwise variously embodied and employed, and the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

What is claimed is:

1. A lateral elliptical trainer, comprising:

a frame;

a left foot support platform coupled to the frame via a first linkage system, the first linkage system configured to enable longitudinal and lateral movement of the left foot support platform;

a right foot support platform coupled to the frame via a second linkage system, the second linkage system configured to enable longitudinal and lateral movement of the right foot support platform; and a lateral adjustment system coupled to the left linkage system and the right linkage system, and operative to adjust the amount of lateral movement of the left foot support platform and the right foot support platform, the lateral adjustment system comprising:

a first carriage slidably coupled to the first linkage system;

a second carriage slidably coupled to the second linkage system;

a cable coupled to the first carriage and the second carriage; and a cable actuator coupled to the cable and operative to move the first carriage and the second carriage relative to the first linkage system and the second linkage system, respectively, via the cable to adjust the amount of lateral movement of the left foot support platform and the right foot support platform, respectively.

2. The lateral elliptical trainer of claim 1, wherein the cable includes first and second end portions coupled to the cable actuator.

3. The lateral elliptical trainer of claim 2, wherein the cable actuator comprises a rotatable drum to which the first and second end portions of the cable are coupled such that rotation of the drum causes one of the first and second end portions of the cable to be wrapped around the drum and the other of the first and second end portions of the cable to be unwrapped from the drum.

4. The lateral elliptical trainer of claim 3, wherein the drum is rotatable in opposite directions.

5. The lateral elliptical trainer of claim 3, wherein the drum is rotatably mounted in a housing that is coupled to the frame.

6. The lateral elliptical trainer of claim 5, wherein the lateral adjustment system further comprises first and second springs abutted against the housing and operatively coupled to the cable.

7. The lateral elliptical trainer of claim 3, wherein the cable actuator further comprises a motor operatively coupled to the drum to rotate the drum in response to a user's command to laterally move the left and right foot support platforms.

8. The lateral elliptical trainer of claim 1, wherein the cable is fixedly coupled to the first carriage and the second carriage such that the first carriage and the second carriage move in unison with the cable.

9. The lateral elliptical trainer of claim 8, wherein the cable is routed between the first carriage and the second carriage such that the first carriage and the second carriage move in substantially the same direction during operation of the cable actuator.

10. The lateral elliptical trainer of claim 1, wherein the cable comprises:

a first cable having a first end portion coupled to the cable actuator and a second end portion coupled to the first carriage;

a second cable having a first end portion coupled to the cable actuator and a second end portion coupled to the second carriage; and a third cable having a first end portion coupled to the first carriage and a second end portion coupled to the second carriage.

11. The lateral elliptical trainer of claim 10, wherein the third cable is routed between the first carriage and the second carriage such that the first carriage and the second carriage move in substantially the same direction during operation of the cable actuator.

12. The lateral elliptical trainer of claim 10, wherein the lateral adjustment system further comprises:

a first pulley positioned between the cable actuator and the first carriage, and about which the first cable is routed;

a second pulley positioned between the cable actuator and the second carriage, and about which the second cable is routed; and a third pulley positioned between the first carriage and the second carriage, and about which the third cable is routed.

13. The lateral elliptical trainer of claim 12, wherein the lateral adjustment system further comprises a fourth pulley positioned between the first carriage and the second carriage, and about which the third cable is routed.

14. The lateral elliptical trainer of claim 1, wherein each of the first linkage system and the second linkage system comprises:

a rocker arm having an upper portion coupled to the frame, and a lower portion;

a foot link having a front portion coupled with the lower portion of the rocker arm, and a rear portion; and a lateral glide link having a front portion pivotally coupled with the rear portion of the foot link, and a rear portion, wherein one of the left and right foot support platforms is coupled to a rear portion of the lateral glide link; and a lateral linkage having a front portion coupled with the rocker arm, and a rear portion coupled with the lateral glide link.

15. The lateral elliptical trainer of claim 14, wherein the front portion of the lateral linkage is selectively moveable along a length of the rocker arm to move the respective foot support platform in a lateral direction.

16. The lateral elliptical trainer of claim 14, wherein:

the first carriage is coupled to the rocker arm of the first linkage system and is slidable along a length of the rocker arm of the first linkage system;

the front portion of the lateral linkage of the first linkage system is pivotally coupled to the first carriage such that the front portion of the lateral linkage of the first linkage system is movable along the length of the rocker arm of the first linkage system;

the second carriage is coupled to the rocker arm of the second linkage system and is slidable along a length of the rocker arm of the second linkage system; and the front portion of the lateral linkage of the second linkage system is pivotally coupled to the second carriage such that the front portion of the lateral linkage of the second linkage system is movable along the length of the rocker arm of the second linkage system.

17. The lateral elliptical trainer of claim 16, wherein the lateral adjustment system further comprises a position sensor coupled to the rocker arm of one of the first linkage system or the second linkage system and configured to detect the position of one of the first carriage or the second carriage, respectively.

18. The lateral elliptical trainer of claim 17, wherein the lateral adjustment system further comprises upper and lower limit switches coupled to the rocker arm of the other of the first linkage system or the second linkage system and configured to deactivate the lateral adjustment system in response to actuation by the other of the first carriage or the second carriage, respectively.

19. A lateral adjustment system for a lateral elliptical trainer, comprising:

first and second carriages configured to be slidably coupled to first and second linkage systems, respectively, of the lateral elliptical trainer;

a cable coupled to the first and second carriages; and a cable actuator coupled to the cable and operative to move the first and second carriages relative to the first and second linkage systems, respectively, via the cable to adjust the amount of lateral movement of left and right foot support platforms, respectively, of the lateral elliptical trainer.

20. A method of controlling lateral displacement of a foot support platform on a lateral elliptical trainer, the method comprising:

rotating a drum;

moving first and second carriages, coupled to the drum via one or more cables, along a length of first and second rocker arms, respectively, in response to rotating the drum; and moving first and second foot platforms, coupled to the first and second carriages, respectively, via first and second linkage systems, respectively, in a lateral direction in response to moving the first and second carriages, respectively.

* * * * *